US008006489B2

(12) United States Patent
Dickinson et al.

(10) Patent No.: US 8,006,489 B2
(45) Date of Patent: Aug. 30, 2011

(54) EXHAUST DIFFUSER FOR A VOCATIONAL TRUCK

(75) Inventors: Hugh Thomas Dickinson, Greensboro, NC (US); Clinton Lane Lafferty, Jackson, TN (US); Rayvonn Donnell Core, Mebane, NC (US)

(73) Assignee: Volvo Group North America, LLC, Greensboro, NC (US)

( * ) Notice: Subject to any disclaimer, the term of this patent is extended or adjusted under 35 U.S.C. 154(b) by 273 days.

(21) Appl. No.: 12/310,753

(22) PCT Filed: Dec. 21, 2006

(86) PCT No.: PCT/US2006/048888

§ 371 (c)(1),
(2), (4) Date: Mar. 6, 2009

(87) PCT Pub. No.: WO2008/030258

PCT Pub. Date: Mar. 13, 2008

(65) Prior Publication Data

US 2010/0083647 A1 Apr. 8, 2010

Related U.S. Application Data

(60) Provisional application No. 60/842,842, filed on Sep. 7, 2006.

(51) Int. Cl.

| | |
|---|---|
| ***F01N 1/00*** | (2006.01) |
| ***F01N 3/02*** | (2006.01) |
| ***F01N 5/04*** | (2006.01) |

(52) U.S. Cl. ..... 60/324; 60/317; 60/319

(58) Field of Classification Search ..... 60/324, 60/317, 319

See application file for complete search history.

(56) References Cited

U.S. PATENT DOCUMENTS

| | | | | |
|---|---|---|---|---|
| 2,325,543 | A | 3/1942 | Renius | |
| 2,473,103 | A | 6/1949 | Lathers | |
| 2,508,615 | A * | 5/1950 | Lukes | 454/6 |
| 3,380,553 | A | 4/1968 | Gibel | |
| 4,696,368 | A | 9/1987 | Hummel | |
| 4,782,912 | A | 11/1988 | Wandless | |
| 5,304,749 | A * | 4/1994 | Crandell | 181/264 |
| 7,779,961 | B2 * | 8/2010 | Matte | 181/227 |

FOREIGN PATENT DOCUMENTS

EP 0719975 A1 3/1996

OTHER PUBLICATIONS

Dynaflex, 2003, Catalog 150B 2003, p. 104.*

Supplementary European Search Report dated Sep. 28, 2010 for corresponding application No. EP 06847965.

* cited by examiner

*Primary Examiner* — Thomas Denion
*Assistant Examiner* — Michael Carton
(74) *Attorney, Agent, or Firm* — Martin Farrell; Michael Pruden

(57) ABSTRACT

An exhaust diffuser for a truck includes a chamber mountable on a truck exhaust stack pipe. The chamber has a cross sectional area much greater than the cross sectional area of the exhaust pipe, and has a dispersing element disposed in the line of exhaust flow to divert exhaust gases laterally into the chamber volume. One or both of the top and front side walls are formed as a mesh or screen to allow the dispersed exhaust gases to flow outward away from the truck cab in a diffused area.

5 Claims, 3 Drawing Sheets

EXHAUST DIFFUSER FOR A VOCATIONAL TRUCK

This application claims the benefit of U.S. Provisional Patent Application No. 60/842,842, filed Sep. 7, 2006.

The invention relates to devices mounted on truck exhaust systems to dilute and diffuse the exhaust gas as it is released from the truck

BACKGROUND

Exhaust treatment devices in trucks require maintenance procedures that can create situations where exhaust temperatures are much higher than during normal use of the vehicle. For example, diesel particulate filters, which trap soot and other particulate matter in the exhaust stream, require a regeneration process to burn off the collected soot. The process requires that the temperature of the exhaust entering the diesel particulate filter be in excess of 600° C. Normal operating exhaust temperature is about 425° C. for a diesel engine in a truck.

Exhausting the higher temperature gases to atmosphere poses difficulties. A truck typically has an exhaust stack pipe rising from the chassis adjacent to the truck cab. High temperature exhaust can produce a hot spot on the truck cab or trailer.

In addition, in vocational trucks (dump trucks, trash hauling trucks, etc), the exhaust stack and the exhaust gases must not interfere with the operation of the body, lifting the dump body, for example.

What is needed is a device to reduce the exhaust temperature without drastically affecting the exhaust backpressure.

SUMMARY OF THE INVENTION

According to a preferred embodiment of the invention suitable for vocational trucks such as dump trucks and trash collection trucks, a diffuser box is mounted at the end of the exhaust stack. The diffuser box is mounted downstream of the catalyst and diesel particulate filter (DPF) in the exhaust system. The diffuser box allows exhaust gases to dissipate over a larger area than does a standard exhaust pipe, which helps avoid concentrations of hot gases. A first embodiment of a diffuser box includes a side outlet. A second embodiment has a top outlet. An inlet of the diffuser box is mountable on an outlet of an exhaust stack pipe. Both embodiments incorporate a dispersing element mounted in line with the box inlet to cause the exhaust gases to flow throughout the box before exiting so that there are no localized high temperatures. According to a preferred embodiment, the dispersing element is cone shaped and disposed with the apex of the cone point toward the box inlet.

The exhaust gases then exit the box through a meshed grill to the atmosphere. The meshed area has been optimized to create a larger area for dissipation compared to the normal round exhaust pipe outlet. This also minimizes the affect on backpressure.

BRIEF DESCRIPTION OF THE DRAWINGS

The invention will be better understood by reference to the following detailed description read in conjunction with the appended drawings, in which.

DETAILED DESCRIPTION

The invention relates to devices that are mounted on the end of a truck exhaust system at the point where exhaust gas is released to the surrounding air. The devices of this invention diffuse the exhaust gas over a wider area than a typical exhaust stack pipe to prevent hot spots and dissipate heat more quickly.

Figure 1:
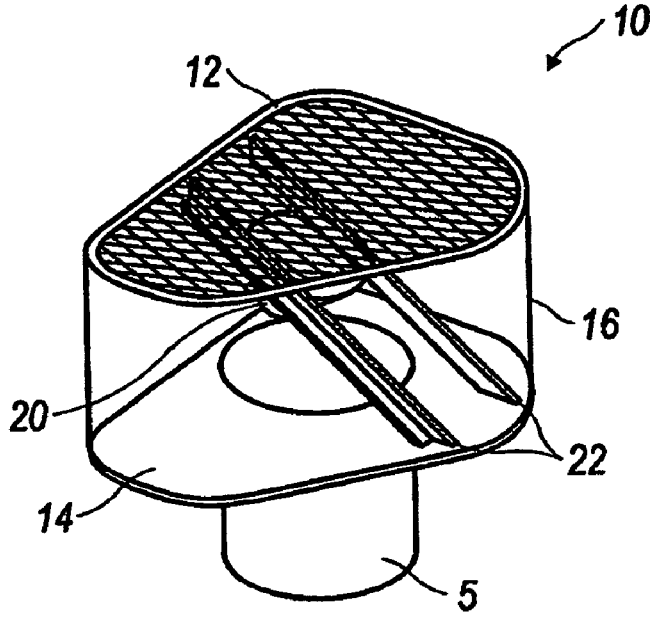
FIG. 1 shows a first embodiment of a diffuser box with top outlet for a truck exhaust.
Figure 2:
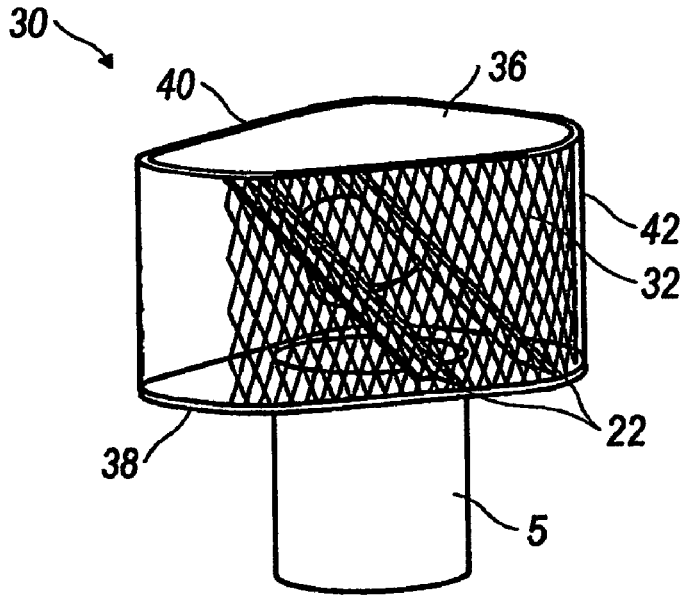
FIG. 2 shows a second embodiment of a diffuser box with side outlet for a truck exhaust; and, FIG. 2 shows a second embodiment of a diffuser box with side outlet for a truck exhaust.

A diffuser in accordance with the invention shown in FIGS. 1 and 2 comprises a box mounted at the outlet end of an exhaust stack pipe. Turning first to FIG. 1, the box 10, which is shown with the front wall removed, has a harp or modified D shape when viewed from the top. As may be seen in FIG. 3, the harp shape provides volume for the box as well as clearance from the cab when mounted on a stack pipe. The box 10 has a top outlet, consisting of a mesh or screen covering 12 to allow the outflow of exhaust gas flowing from the stack pipe 5. The floor 14 and the peripheral wall 16 are solid to prevent the outflow of gas in those directions, which protects the cab and adjacent structure.

A dispersing element 20 is mounted in the box at the outlet of the stack pipe 5. According to the illustrated embodiment, the dispersing element is cone shaped. The dispersing element 20 is mounted on two bars in disposition over the opening in the stack pipe 5 and in the flow path of the exhaust gas. The point of the cone faces into the gas flow. The dispersing element 20 presents a surface that diverts the exhaust gas from axial flow to flow radially outward into the box 10 volume before exiting the box. This allows the gas to diffuse over the area defined by the top covering 12 as it exits the box 10. The dispersing element 20 is shown with its cone axis at an angle to the axial direction of the stack pipe 5.

Figure 2A:
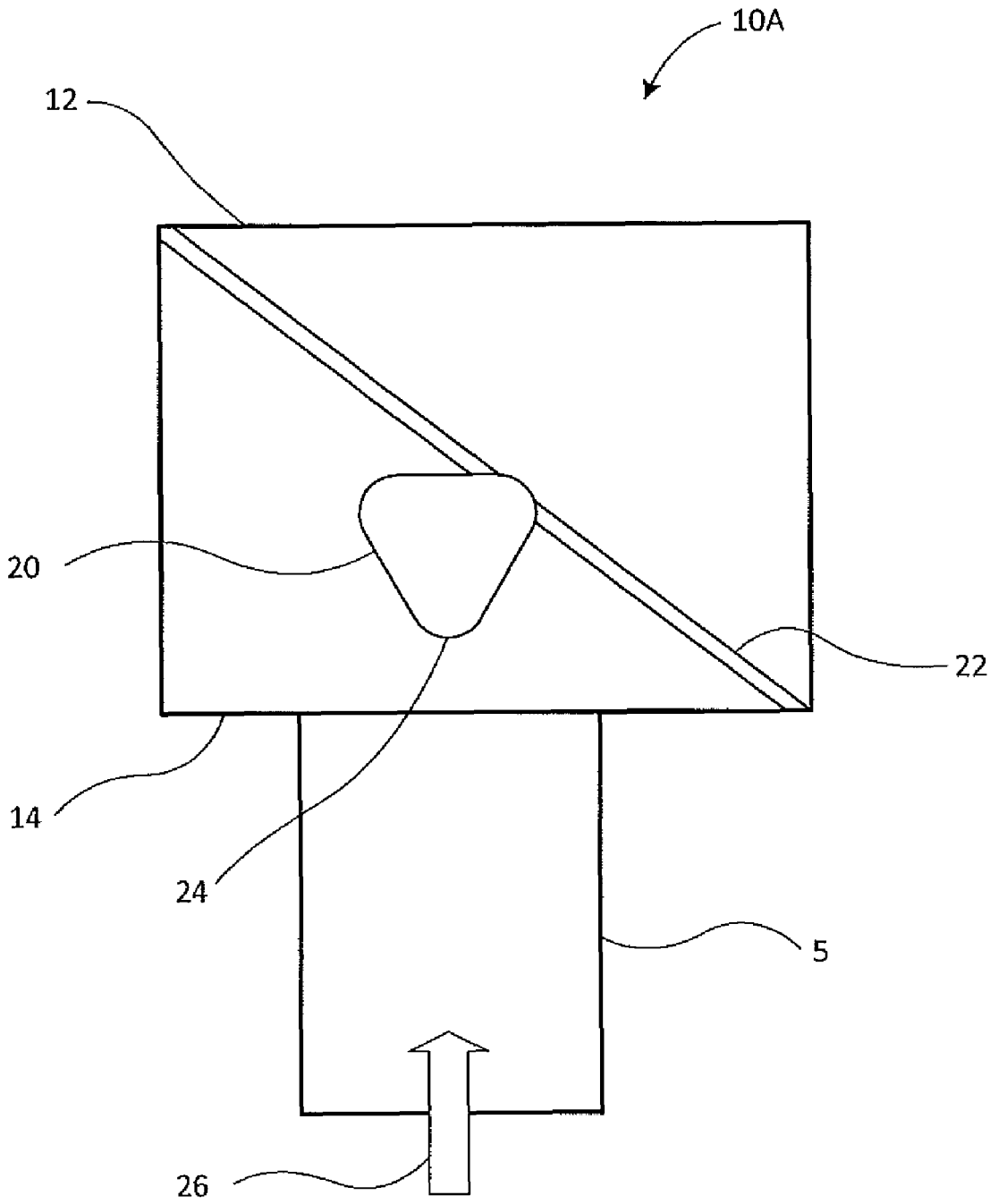
FIG. 2A shows in section view a diffuser box with a dispersing element in an orientation axially aligned with a flow from an exhaust pipe; and, FIG. 3 shows a diffuser box of FIG. 1 mounted on a truck cab exhaust.

Alternatively, as shown in FIG. 2A, the dispersing element 20 may be mounted so that the point of the cone 24, and accordingly the cone axis, is aligned with the flow direction of the stack pipe 5, indicated by the arrow 26.

FIG. 2 is a second embodiment of a diffuser box 30 having a side outlet opening in which a mesh or screen 32 replaces part of the peripheral wall 34. The top 36 and bottom walls 38 are solid. Rear portions 40, 42 of the peripheral wall 34 are solid to prevent the outflow of gas in that direction, which faces the cab. A dispersing element 20, identical to that of FIG. 1 is mounted on bars 22 in the flow path above the outlet of the stack pipe 5. The dispersing element 20 is mounted with the cone axis at an angle to the gas flow direction from the stack pipe 5. This diverts the gas to fill the box 30 and flow outward through the screen 32 in a diffuse flow. As in the preceding embodiment, the dispersing element 20 can be arranged with the cone axis aligned with the gas flow from the stack pipe 5.

Alternatively, both the top wall and front portion of the peripheral wall could be formed with mesh to allow diffuse flow in a broader area.

The dispersing element 20 is illustrated as a cone. However, other shapes as will occur to those skilled in the art may be substituted if capable of diverting gas flow from a substantially linear flow to a radially outwardly directed flow.

Analysis of both boxes 10, 30 shows that the temperature of the exhaust during DPF regeneration exiting the boxes will be at a temperature comparable to normal exhaust temperatures (not during filter regeneration) at about six inches from the box outlet.

Figure 3:
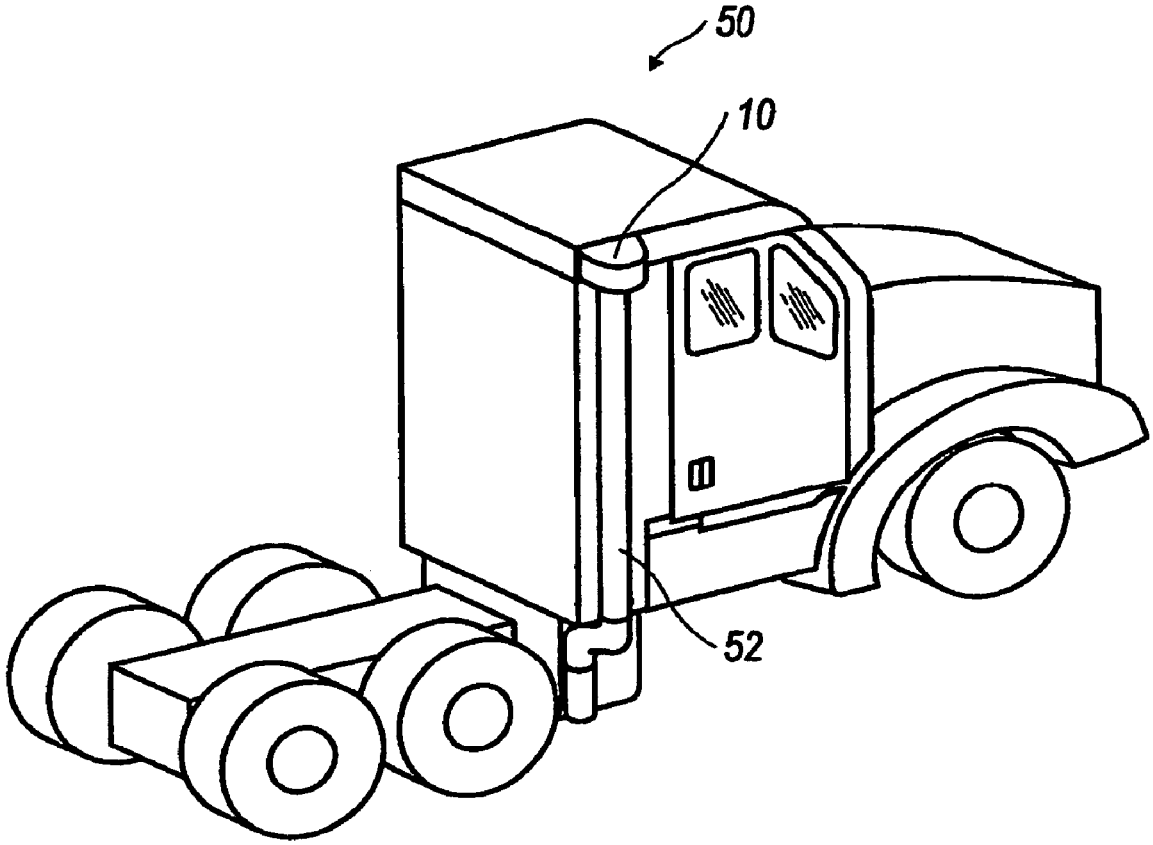

Advantageously, as shown in FIG. 3 and known to those skilled in the art, truck exhaust stacks are mounted adjacent the truck cab 50, the invention prevents excess heat from exhaust gas at the cab walls. As an example of how the invention integrates with a cab and exhaust stack, FIG. 3 shows a box 30 as described in connection with FIG. 2 mounted on a truck cab 50. Box 30 is mounted at the end of an exhaust stack pipe 52. The box 30 extends to the top 54 of the cab 50. As may be appreciated, the peripheral wall 40 of the box 30 (as would the peripheral wall 16 of the box 10) prevents hot exhaust gas from contacting the cab 50.

The invention has been described in terms of preferred embodiments and structure; however those skilled in the art will understand that substitutions and variations may be made without departing from the scope of the invention as defined in the appended claims.

What is claimed is:

1. A diffuser for an engine exhaust, comprising: a chamber configured to be mounted on a top end of an exhaust stack pipe, the chamber enclosed by a bottom wall, a top wall and a peripheral wall, the chamber having an axial direction perpendicular to the top wall and bottom wall, the bottom wall being formed as a solid wall having an inlet opening to couple with an engine exhaust conduit, the peripheral walls wall being formed as with a first portion as a mesh to form an exhaust outlet and a second portion being solid to prevent exhaust flow there through, the chamber being sized to allow exhaust gas to expand therein; and, a dispersing element mounted in the chamber and disposed relative to the inlet opening to divert inflowing exhaust gas from the axial direction to facilitate exhaust gas expanding in the chamber.

2. The diffuser of claim 1, wherein the top wall is formed as a mesh to provide an additional outlet of the chamber.

3. The diffuser of claim 1, wherein the dispersing element is a conical shaped element, and is disposed with a cone point directed toward the inlet opening.

4. The diffuser of claim 3, wherein the cone is axially aligned with the inlet opening.

5. The diffuser of claim 1, wherein the exhaust outlet of the chamber has an area larger than an area of the inlet opening.

* * * * *